United States Patent [19]

Hayman

[11] 4,088,075

[45] May 9, 1978

[54] FIRING CIRCUIT

[75] Inventor: Robert A. Hayman, Williamsville, N.Y.

[73] Assignee: The United States of America as represented by the Secretary of the Army, Washington, D.C.

[21] Appl. No.: 702,652

[22] Filed: Jul. 6, 1976 (Under 37 CFR 1.47)

[51] Int. Cl.[2] ..... F42C 11/00; F42C 15/14

[52] U.S. Cl. ..... 102/70.2 R; 102/19.2

[58] Field of Search ..... 102/70.2 R, 19.2

[56] References Cited

U.S. PATENT DOCUMENTS

| | | | |
|---|---|---|---|
| 3,504,632 | 4/1970 | West et al. | 102/70.2 R |
| 3,575,114 | 4/1971 | Quist et al. | 102/70.2 R |
| 3,598,056 | 8/1971 | West et al. | 102/70.2 R |
| 3,665,860 | 5/1972 | West | 102/70.2 R |
| 3,690,259 | 9/1972 | Piazza et al. | 102/70.2 R |
| 3,750,586 | 8/1973 | Swallow et al. | 102/70.2 R |

*Primary Examiner*—Charles T. Jordan
*Attorney, Agent, or Firm*—Nathan Edelberg; A. Victor Erkkila; Thomas R. Webb

[57] ABSTRACT

The firing circuit comprises a direct current voltage source having negative and positive terminals connected, respectively, to first and second terminals of a firing network. The network comprises first and second resistors connected, respectively, to the first and second network terminals. A diode, a silicon controlled rectifier (SCR), an electrical detonator and a third resistor are connected in series with each other and in parallel with the first and second terminals, respectively, with the anode of the diode connected to the cathode of the SCR, and the gate of the SCR connected to the junction of the first and second resistors. A capacitor and a fourth resistor are connected in parallel with the combination of the SCR and the detonator. In a modification, a Zener diode is connected in parallel with the capacitor. The circuit is designed to be normally energized without firing the SCR and detonator, and to fire the SCR and detonator if: the voltage source is (1) suddenly disconnected from the network or (2) rapidly decreased; or (3) the input terminals of the network are short-circuited, or (4) too high a voltage is applied to the network.

8 Claims, 5 Drawing Figures

FIRING CIRCUIT

GOVERNMENTAL INTEREST

The invention described herein was made in the course of a contract with the U.S. Government.

BACKGROUND AND SUMMARY OF THE INVENTION

The present invention relates to a new and improved firing circuit, for use in an anti-disturbance explosive mine, for example. An anti-disturbance mine is one that is provided with some means for exploding the mine when it is disturbed, for example by enemy personnel in attempting to move or re-use the mine. Such exploding means are usually mechanical or chemical, rather than electrical in nature.

The present invention provides an electrical firing circuit which can be harmlessly activated by a suitable voltage source, by means of wires from a remote location, for example, but adapted to be quickly and reliably fired or triggered by: (1) sudden loss of voltage, due to breaking or otherwise disconnecting one or more voltage leads; (2) short-circuiting of the supply voltage terminals; (3) too rapid a decrease of the voltage supply; or (4) too high a supply voltage applied.

This firing circuit comprises a direct current voltage source or battery connected to a network comprising: a series combination of an SCR and an electrical detonator connected in parallel with a capacitor and a resistor and in series with another resistor, the voltage source and diode, in such manner that the SCR is connected to a point in the circuit having a normal potential lower than the cathode of the SCR. Preferably, this point is the junction of two series resistors connected across the voltage source, so that the gate potential is greater than zero.

DETAILED DESCRIPTION OF A PREFERRED EMBODIMENT

Figure 1:
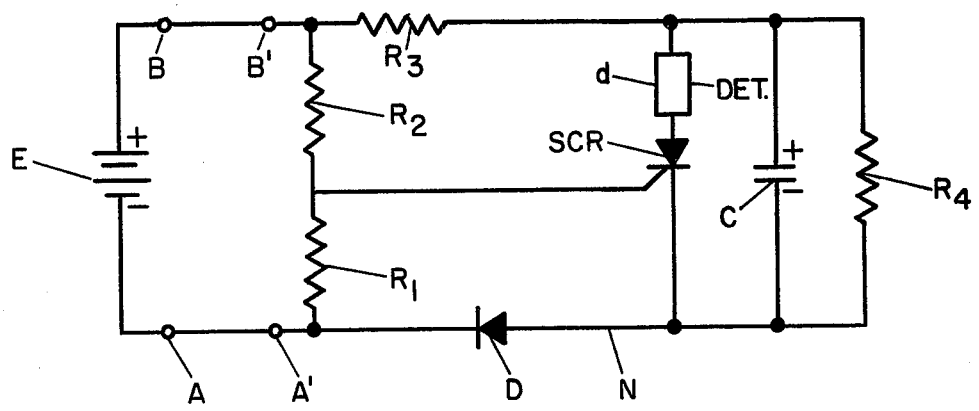
FIG. 1 is a diagram of a firing circuit embodying the present invention.

FIG. 1 shows a firing circuit embodying the present invention. The circuit is made up of a network N having first and second terminals A′ and B′ and a direct current voltage source E having negative and positive terminals A and B connected, respectively, to terminals A′ and B′. The network N comprises first and second series resistors $R_1$ and $R_2$ connected, respectively, to terminals A′ and B′. A diode D, a silicon controlled rectifier SCR, an electric detonator *d*, and a third resistor $R_3$ are connected in series with each other and in parallel with the terminals A′ and B′, respectively, with the anode of the diode connected to the cathode of the SCR, as shown. The gate of the SCR is connected to the junction of resistors $R_1$ and $R_2$. A capacitor C and a fourth resistor $R_4$ are connected in parallel with the combination of the SCR and the detonator *d*.

For example, the network N may be part of or associated with an anti-disturbance explosive mine and connected by wires with a remote voltage source E, so that an attempt by enemy personnel to move or re-use the mine will result in triggering of the SCR and detonator, by either disconnecting the voltage source from the network or shortcircuiting the network terminals.

The following is a brief analysis of the proposed circuit.

I. Operational Considerations

A. Source E operational limits: 12v to 15v;

B. Temperature operational limits: −25° F to +125° F;

C. Should trigger under the following conditions:

1. Sudden loss of source potential due to sudden open between A and A′ or B and B′, or both;
2. Loss of source potential due to sudden short across A–B or A′–B′;
3. Rapid decrease in potential between A′ and B′; or
4. Increase in potential above some threshold level at A′–B′.

D. Quiescent current drain from source (E) should not exceed 200 μA.

II. General Operation (Refer to FIG. 1)

In the quiescent state, the current through $R_3$ is limited by the leakage currents through resistor $R_4$, capacitor C, and the SCR. This total leakage current passes through the diode D and establishes a voltage drop $V_2$ across D. Resistors $R_1$ and $R_2$ form a voltage divider with a small voltage drop across $R_1$. If the voltage drop aacross $R_1$ is less than the voltage drop $V_2$, the gate to cathode voltage of the SCR will be negative. In this case, the SCR will remain in a blocked state. If the gate to cathode voltage exceeds some positive threshold, the SCR will conduct from anode to cathode. Hence, the objective of the design is to maintain the gate negative with respect to the cathode except for those conditions for which SCR firing is desired. The design consideration leading to the selection of the various components and specifications of their values will be discussed. In Section III, an evaluation is made of the factors influencing the gate to cathode potential from turn-on, or application of power, to quiescent state. From this evaluation, various component values will be established. Section IV considers the case of removal of source potential or an open between A′ and B′ to determine adequacy of triggering. Section V considers the case of a short across A′–B′ for triggering action evaluation. In Section VI, the rate at which the source potential can be decreased is investigated to determine the maximum rate of decrease which will still maintain the SCR in a non-conducting state. Section VII considers triggering characteristics to provide high voltage protection for the circuit.

III. Source Application

This portion of the analysis considers the quiescent characteristics of the circuit including the transient introduced in connecting the circuit to the source.

Let the combination of leakages due to the capacitor C, the SCR and resistor $R_4$ be represented by an equivalent resistor, $R_5$. The circuit for this analysis can then be represented by FIG. 2. All voltages noted will be referenced to the cathode of the diode D unless otherwise specified. In order to insure that the circuit does not misfire upon application of the source, the gate to cathode voltage must not become positive at any time from source application through reaching the quiescent state.

The voltage $V_o$ at the gate results from the voltage divider network $R_1$ and $R_2$ across the source E. The effect of gate loading on $R_1$ is negligible. The voltage, $V_o$, as a function of time is given by $$V_{o(t)} = \frac{R_1}{R_1 + R_2} \times E_{(t)} \tag{1}$$

where $E_{(t)}$ is the source voltage as a function of time. Thus, for a switch "on" or step application of E, the gate voltage $V_o$ is present at $t=0$.

In order to insure gate to cathode voltage $V_2$ negative, the cathode voltage must be greater than $V_o$ starting at $t=0$. For the IN914 diode, forward current $I_f$ values of $10^{-6}$ to $10^{-4}$ ampere result in diode voltages $V_2$ of 0.38 to 0.6 volt in a nonlinear fashion. At about $I_f = 10^{-2}$ ampere, $V_2 = 1.0$ volt.

As an approximation for ease of analysis, assume that the diode is an ideal unilateral switch and neglect $V_2$. This assumes that the turn-on time, $t_D$, of the IN914 diode D is much less than the charge time constant T for capacitor C at $t = 0$. A real diode can be modeled as an ideal diode in parallel with a capacitor, as shown in the drawing. At $t = 0$ the two capacitors C and $C_D$ act like shorts. Thus, at $t = 0$, the voltage $V_g$ of the SCR gate relative to the cathode is $R_1E/(R_1 + R_2)$, which is greater than the trigger voltage of the SCR. However, the SCR does not fire because it is shorted by capacitor C. The real diode acts like an ideal diode when the diode voltage drop $V_D$ is about 0.6 volt. Then, $$i = C\frac{dV_c}{dt} = C_D\frac{dV_D}{dt}$$

$$\int idt = \int_o^{V_c} CdV_c = \int_o^{V_D} C_D dV_D$$

$$it_o = CV_C = C_DV_D$$

$$V_C = \frac{C_D}{C} V_D.$$

For $C_D = 10^{-12}$ farad, and $C = 10^{-4}$ farad, $$V_C = 10^{-12}/10^{-4}(0.6) = 0.006 \times 10^{-6} \text{ volt.}$$

Thus, when $V_D$ is 0.6 volt, the voltage on the capacitor C is extremely small.

The equations for determining the SCR anode voltage $V_{1(t)}$ and current $I_{(t)}$ are developed as follows:

$$E_{(S)} = i_{(S)}\left[R_3 + \frac{\frac{R_5}{SC}}{R_5 + \frac{1}{SC}}\right] \tag{2}$$

and $$E_{(S)} = i_{(S)}R_3 = V_{1(S)}, \tag{3}$$

resulting in $$\frac{V_{1(S)}}{E_{(S)}} = \frac{R_5}{R_5 + R_3} \cdot \frac{1}{SC\frac{R_5R_3}{R_5 + R_3} + 1}. \tag{4}$$

For a step input of E, one obtains $$V_{1(S)} = \frac{R_5E}{R_5 + R_3} \cdot \frac{1}{SC\frac{R_5R_3}{R_5 + R_3} + 1} \tag{5}$$

or $$V_{1(t)} = \frac{R_5E}{R_5 + R_3}\left[1 - e^{-t/\frac{R_5R_3C}{R_5 + R_3}}\right]. \tag{6}$$

Changing Equation (3) to time and substituting from Equation (6), one obtains for $i_{(t)}$ $$i_{(t)} = \frac{E - V_{1(t)}}{R_3} \tag{7}$$

$$i_{(t)} = \frac{E}{R_3}\left[\frac{R_3 + R_6e^{-t/\frac{R_5R_3C}{R_5 + R_3}}}{R_5 + R_3}\right]. \tag{8}$$

From Equation (8) it can be seen that:

at $t \cong 0$,
$i_{(t)} \cong E/R_3$,
and at $t \rightarrow \infty$ (quiescent)
$i_{(t)} \cong (E/R_5 + R_3)$.

Letting $E = 15$ volts and $R_3 = 10\ k\ \Omega$, at $t \cong 0$, the current $i_{(t)}$ will be about 1.5 ma. Also, from Equation (6), the voltage $V_1$ will be about 0.0 volt at $t \cong 0$. This current will pass through diode D. As noted before, a current of this magnitude will develop a voltage across the diode. This voltage drop will be approximately 0.6 volt for a current I of 1.5 ma. Therefore, at $t = 0$, the gate to cathode voltage would be negative for $V_o < 0.6$ volt.

Now consider the quiescent value, since $i_{(t)}$ decreases to this limit exponentially. In order to maintain a cathode voltage $V_2$ of about 0.38 to 0.48 volt, a forward current of $3 \times 10^{-6}$ to $20 \times 10^{-6}$ ampere through the diode is required. Therefore, for $E = 11$ to 15 volts, $R_5 + R_3$ should be about 0.5 MΩ to 5.0 MΩ to stay in the $3 \times 10^{-6}$ to $20 \times 10^{-6}$ ampere range. If the SCR and C leakage currents become negligible, the current must be maintained through $R_4$, the physical resistor. Thus, a value of 1 MΩ for $R_4$ will insure a stable forward current through the diode of $11 \times 10^{-6}$ to $15 \times 10^{-6}$ ampere as a minimum over the source operational level, resulting in a minimum $V_2$ of about 0.38 volts.

At a maximum, $E = 15$ volts, the gate voltage $V_o$ must be $\leqq 0.38$ volts to insure that the SCR gate to cathode voltage is zero or negative. Using Equation (1), one finds $$V_o = \frac{R_1}{R_1 + R_2} \times 15 \leqq .38 \tag{9}$$

$$\frac{.38}{15} \geqq \frac{R_1}{R_1 + R_2},$$

or $$\frac{R_2}{R_1} \geqq 38.5. \tag{10}$$

In order to provide adequate gate current capability, assume that the current through $R_1 + R_2$ is about $10^{-4}$ amp. at $E = 15$ volts. Therefore, $R_1 + R_2 = 150$ kΩ. Substituting this value into Equation 9 one finds that $R_1 = 3.8 \times 10^3 \Omega$.

From the above portion of the analysis, the following values are selected for the appropriate components of FIG. 1, taking into account component variability in value.

$R_1 = 3.3\ k\Omega$
$R_2 = 150\ k\Omega$
$R_3 = 9.4\ k\Omega$
$R_4 = 1\ M\Omega$ From equation (1), the gate voltage $V_o = 0.323$ volt, which is less than the cathode voltage $V_2 = 0.38$ volt, as required to prevent firing of the SCR.

Since a requirement for energy and potential to insure proper operation of the detonator is not known, it is assumed that a capacitor C having a nominal value of 100 $\mu f$ with greater than about 10 volts will provide proper operation. If it is found that this value of capacity can be decreased, and still insure proper operation, then savings in space and cost may be achieved without compromise.

In preliminary designs, satisfactory operation was obtained in a number of circuits with the following values:

$R_1 = 12\ k\Omega$ to $18\ k\Omega$
$R_2 = 560\ k\Omega$
$R_3 = 4.4\ k\Omega$ to $9.4\ k\Omega$
$R_4 = 1\ M\Omega$, $2.2\ M\Omega$ and an IN5248 Zener diode.

From Equation (10), the predicted ratio of $R_2/R_1 \geqq 38.5$. However, with the values used in preliminary designs, $R_2/R_1 = 560/18 = 31$ and $560/12 = 46.6$. Thus, for some values of $R_1$ the criterion of Equation (10) was not adhered to, but still resulted in satisfactory operation. In addition, the gate current capability (i.e., open circuit) would be $I \cong (15/560 + 9.4) \times 10^{-3} \cong 15/570 \times 10^{-3}$ ampere $\cong 26.4\ \mu$ amperes, which resulted in satisfactory operation in all cases over the temperature range of $-25°$ F to $+165°$ F. Therefore, meeting the criteria states provides further assurance that proper operation will occur.

IV. Open Circuit Condition

Figure 2:
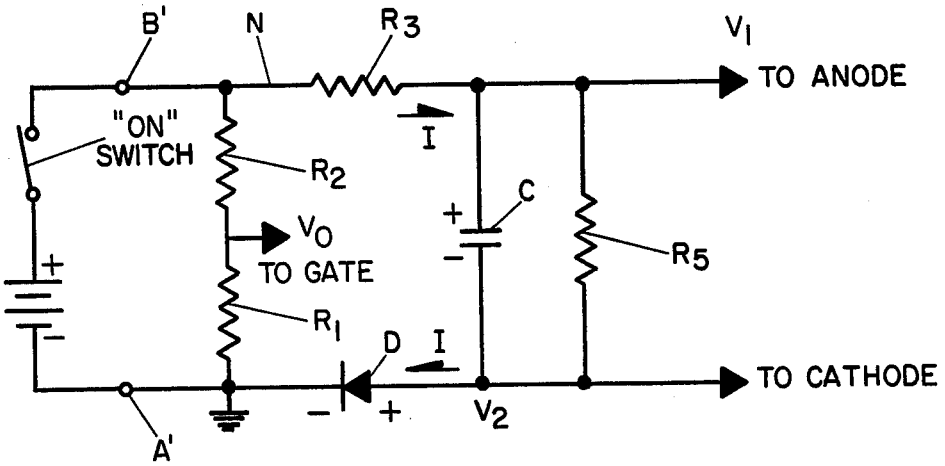
FIG. 2 is a working model of FIG. 1.

In this case it is assumed that quiescent conditions exist and an open circuit develops in A—A' or B—B' or both A—A' and B—B' at $t = 0$. FIGS. 1 and 2 can be simplified to the working model shown in FIG. 3 for analysis of this condition. The diode D, is an IN914, a fast-acting switch (rated at 4 nsec). Thus, at $t = 0^+$, the diode is back biased forming an almost open circuit (> 10 MΩ) except for a small capacity (about 5pf). Since the diode current is zero at $t = 0^+$, the gate current $I_g$ is the same as the current through resistors $R_2$ and $R_3$. Therefore, the gate voltage $V_g$ is $$V_g = V_{C(t)} - I_g(R_2 + R_3).$$

For triggering, $V_g$ must be greater than the minimum gate trigger voltage for the SCR used. For the IN877, this is 0.5 volt. Thus, $$V_{C(t)} - I_g(R_2 + R_3) \geqq 0.5 \text{ volt},$$

or $$I_g \leqq (V_C - 0.5/R_2 + R_3) \text{ amperes.}$$

Assuming that the diode voltage drop $V_D$ is 0.5 volt, and neglecting $V_{R_3}$, $$V_{C(t)} = E - V_D = 15 - 0.5 = 14.5 \text{ volts.}$$

Thus, $$I_g \leqq [14.5 - 0.5/(150 + 10)] \times 10^{-3}$$

$$I_g \leqq 0.088 \text{ mA.}$$

This gate current is within the range of the IN877 SCR, whose gate trigger voltage is 40 $\mu$A, or 0.04 mA.

For $Cd = 5 \times 10^{-12}$ fd, the time constant $T_1$ for current flow through $R_2$, $R_3$, $R_1$ and Cd is approximately:

$$T_1 = \Sigma R \times Cd = [150 + 9.4 + 3.3] \times 10^3 \times 5 \times 10^{-12}$$

$$T_1 \cong 0.8 \times 10^{-6} \text{ sec,}$$

where (the effect of) capacitor C is assumed part of the diode capacity Cd. Thus, within only a few microseconds after the open circuit occurs, the gate potential, $V_o$, would rise almost to the potential of the capacitor C, which is much higher than the triggering potential of the SCR. (This assumed that the gate draws no current and neglects operation of the SCR for this portion of the analysis.)

Limiting the diode switching time to $t <$ about 4 nsecs, it may be assumed that the diode acts as a short. During this time, the parallel resistance $R_P$ of $R_5$ with $\Sigma R = 1.4 \times 10^5 \Omega$. This value of resistance with the capacitor C results in a current:

$$i_{(S)} = \frac{V_c}{S\,(1.4 \times 10^5 + \frac{1}{10^{-4}S})} \tag{11}$$

$$= \frac{10^{-4}V_c}{(1.4S \times 10 + 1)}$$

$$i_{(t)} = 7.1 \times 10^{-6}\, V_c e^{-t/14}.$$

For values of $t = 10^{-9}$ to $10^{-6}$, $e^{-t/14} \cong 1$. Hence, the potential loss across the capacitor C would be negligible within the time required to raise the gate potential ($V_o$) almost to the capacitor potential. After the 4 nsecs, the value of $R_P$ would increase to $10^6\Omega$ plus leakage resistance, with an additionally greater time constant than 14 seconds by a factor $10^6/1.4 \times 10^5 = 7.1$ or a time constant equal to $T = 100$ seconds. As the gate potential passes through the threshold potential needed for triggering the SCR, it can be seen from the above time constants that essentially the full charge on C would be dissipated through the detonator.

V. Short Circuit Condition

Figure 3:
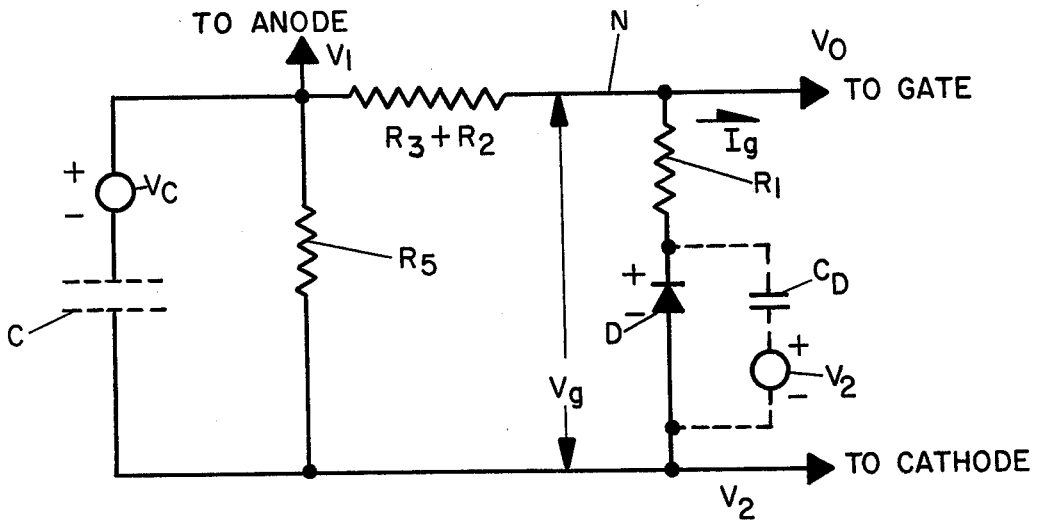
FIG. 3 is a working model of the circuit of FIG. 1 with the voltage source removed.
Figure 4:
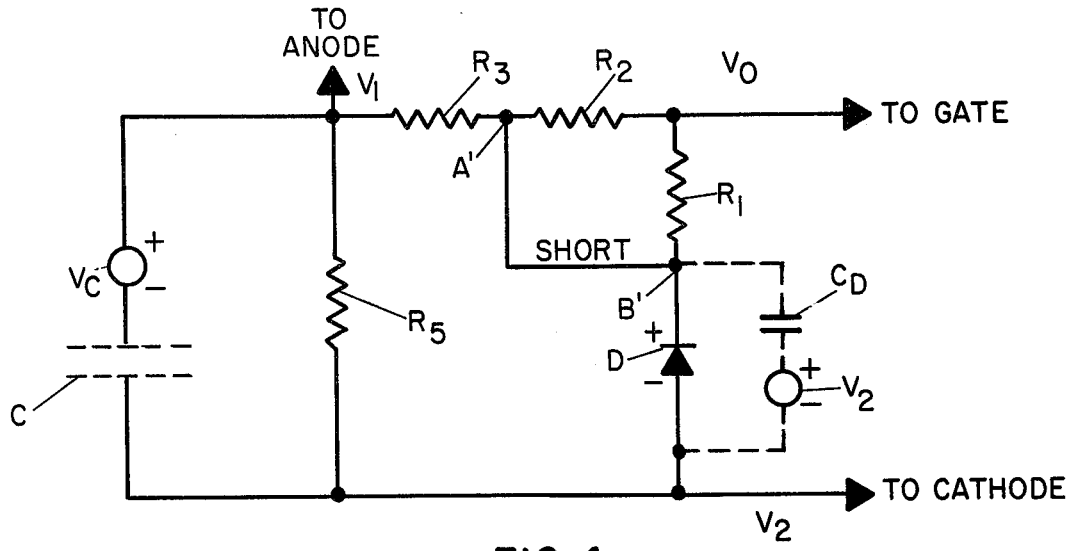
FIG. 4 is a working model of the circuit of FIG. 1 with the input voltage terminals short-circuited.

For this case, quiescent values are assumed and a short develops between A' and B' in FIG. 1. FIG. 1 is simplified to obtain FIG. 4 as the working model. In this condition, there is no source potential (E) applied to the circuit, and the cathode of the diode D and the junction A' are at the same potential, as indicated by the short. Thus, the diode is back-biased as in FIGS. 3 and 4 by the residual charge on the capacitor C. One difference between this condition and the open circuit condition of FIG. 3 is the fact that gate current is now supplied through the parallel combination of $R_1$ and $R_2$. Thus, there is a larger gate current capability for this condition than in the open circuit condition. Another difference is that the diode current does not pass through $R_1$ and $R_2$.

The time constant ($T_1$) for current flow through $C_d$ is approximately:

$$T_1 = \Sigma RC_d, \text{ where } \Sigma R = R_3 = 9.4 \times 10^3 \times 5 \times 10^{-12} = 47 \times 10^{-9} \text{ sec., or 47 nanoseconds} = 0.047 \times 10^{-6} \text{ sec., or } 0.047\ \mu \text{ sec.}$$

This time constant is smaller than that for the open circuit condition, but large compared to the switching time (4 nsecs.) of the diode D. The diode acts as a short, as in the open circuit condition.

The parallel resistanct $R_P$ of $R_5$ with $\Sigma$ R is $9.9 \times 10^3\Omega$.

VI. Source Potential Reduction Rates

In this portion of the analysis consideration is given to the rate at which the source potential can be reduced such that the circuit does not trigger.

Under quiescent conditions, the voltage across the capacitor C is given by (refer to FIG. 2):

$$Vc = R_5E/R_5 + R_3. \quad (12)$$

Recall that $R_5$ is the effective resistive path shunting capacitor C, consisting of SCR leakage, capacitor leakage and $R_4$. Assuming $R_5 = 2 \times 10^5\Omega$ (worst condition) and $R_{3\,b} = 10^4\Omega$ $$Vc \cong 0.95\ E.$$

With the above value of leakage resistance, the charge dissipation rate for the $R_5$ and C combination is $$T = 2 \times 10^5 \times 10^{-4} = 20 \text{ seconds.}$$

If the source voltage E is decreased as $$V_{AB} > E\,e^{-t/20} \quad (13)$$

the diode D will not be back biased and the SCR will not trigger since the applied voltage does not decrease below the capacitor voltage at any time. If the source voltage is decreased at a faster rate than that given in Equation (13), the diode will become back biased and the SCR will fire. Even if one would try to decrease the source potential by insertion of a potentiometer or variable resistor, the resolution may not be adequate to insure that the applied voltage does not fall below the capacitor voltage in some small time interval.

VII. High Voltage Protection

Figure 5:
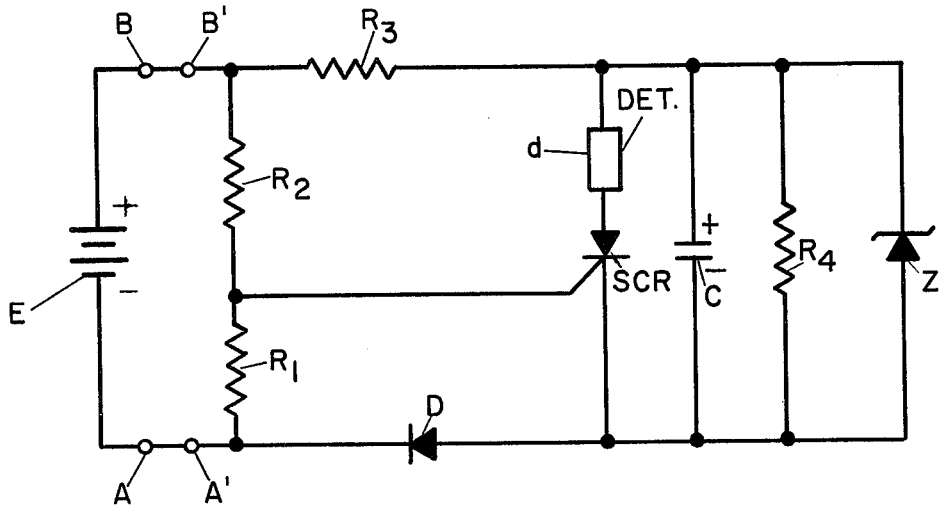
FIG. 5 is a firing circuit diagram showing a modification of FIG. 1.

If, instead of $R_4$ being a resistor, it were replaced by a Zener diode, or a Zener diode in parallel with a large resistor (to insure adequate leakage) as shown in FIG. 5, the following would be apparent.

As the source voltage (E) is increased, the leakage through the Zener diode would increase until the Zener voltage was reached. The capacitor (C) and the SCR anode would be maintained at Zener potential with the difference in applied potential and Zener potential being dissipated across $R_3$. The current through the diode would rise, but the diode voltage drop, even at 10 ma, is only 1 volt.

As an example, assume that $R_1 = 4\ k\Omega$, $R_2 = 150\ k\Omega$, the voltage drop across $R_1 = 2.5$ volts, and the Zener potential = 18 volts:

$$E = V \times [(R_1 + R_2)/R_1] = 2.5 \times 154/4$$

$$E = 96 \text{ volts}$$

$$I = E - V_2/R_3 = 96 - 18/104 = 7.8 \times 10^{-3} \text{ ampere.}$$

From the above, the gate to cathode potential would be about +1.5 volts. This is much greater than the nominal threshold to trigger the SCR. (The maximum value to guarantee firing is 1.7 volts.) Therefore, for this value of applied voltage (96 volts), the SCR would trigger. The value of E required to just provide sufficient triggering potential would be of the order of 60 volts, but depends upon ambient conditions and the particular components.

From the above, one notes one reason for a value of $R_1$ greater than $0\Omega$. $R_1$ shorted would still cause proper operation for quiescent, line short, or line open operation. Another reason for $R_1$ having a fixed value greater than zero is that in the shorted source condition, this resistor provides current limiting as protection for the gate circuit. Also, $R_3$ provides a delay mechanism for protection against misfire.

It has been shown that the firing circuit disclosed will operate as desired under shorted input, open input, decreased potential input (relatively sudden) and increased input potential (if desired).

What is claimed is:

1. In a firing circuit comprising a D.C. voltage source having negative and positive terminals and an electrical network; said network comprising:
   - first and second terminals adapted to be connected to said negative and positive terminals, respectively;
   - a diode, an SCR, an electrical detonator and a resistor connected in series with each other and in parallel with said first and second terminals, respectively, with the anode of said diode connected to the cathode of said SCR, the gate of said SCR being connected to the cathode of said diode; and
   - a firing capacitor and another resistor each connected in parallel across the combination of said SCR and said detonator.

2. In a firing circuit comprising a D.C. voltage source having negative and positive terminals and an electrical network; said network comprising:
   - first and second terminals adapted to be connected to said negative and positive terminals, respectively;
   - a voltage divider network comprising series first and second resistors connected, respectively, to said first and second network terminals;
   - a diode, an SCR, an electrical detonator and a third resistor connected in series with each other and in parallel with said first and second terminals, respectively, with the anode of said diode connected to the cathode of said SCR, the gate of said SCR being connected to the junction of said first and second resistors; and
   - a firing capacitor and a fourth resistor each connected in parallel across the combination of said SCR and said detonator.

3. The network of claim 2, wherein the electrical characteristics of said network are such that the gate-to-cathode voltage of said SCR is not sufficient to fire said SCR and initiate said detonator while said network is energized by said voltage source.

4. The network of claim 3, wherein a sudden loss of potential due to a sudden open between said terminals, after charging of said capacitor, reverses the bias on said diode and increases the gate potential, thus firing said SCR through said detonator.

5. The network of claim 3, wherein a sudden short-circuit between said first and second network terminals, after charging of said capacitor, reverses the bias on said diode and increases the gate potential enough to fire said SCR through said detonator.

6. The network of claim 3, wherein said diode will not become back-biased and said SCR will not fire when said voltage source is decreased under the following conditions:

$$V_{AB} > Ee^{-t/T}$$

wherein $V_{AB}$ is the voltage applied to said network terminals, E is the initial source voltage, $e$ is the naperian base, $t$ is the instantaneous time, and T is the product of the effective resistive path shunting said capacitor and the capacitance of said capacitor.

7. The network of claim 3 having approximately the following electrical characteristics:

Voltage source = 12 to 15 volts
Resistance of first resistor = 3.3 kΩ
Resistance of second resistor = 150 kΩ
Resistance of third resistor = 9.4 kΩ
Resistance of fourth resistor = 1 MΩ
Capacitance of diode = $5 \times 10^{-12}$ fd
Capacitance of capacitor = $10^{-4}$ fd
Switching time of diode = 4 n sec.

8. The network of claim 2, further including a Zener diode connected in parallel with said fourth resistor.

* * * * *